United States Patent [19]

Boyer et al.

[11] 4,440,663

[45] Apr. 3, 1984

[54] ALKALINE AQUEOUS LIQUID DETERGENT COMPOSITIONS CONTAINING NORMALLY UNSTABLE ESTER PERFUMES

[75] Inventors: Stanton L. Boyer; Charles A. Schulz, both of Fairfield, Ohio

[73] Assignee: The Procter & Gamble Company, Cincinnati, Ohio

[21] Appl. No.: 433,492

[22] Filed: Oct. 8, 1982

Related U.S. Application Data

[63] Continuation-in-part of Ser. No. 301,673, Sep. 14, 1981, abandoned.

[51] Int. Cl.[3] ..... C11D 1/66; C11D 3/20; C11D 3/50

[52] U.S. Cl. ..... 252/174.11; 252/108; 252/117; 252/174.18; 252/174.19; 252/174.22; 252/174.25; 560/8; 560/19

[58] Field of Search ..... 252/108, 117, 174.11, 252/174.18, 174.19, 174.22, 174.25; 560/8, 19

[56] References Cited

U.S. PATENT DOCUMENTS

| | | | |
|---|---|---|---|
| 3,668,134 | 6/1972 | Lamberti et al. | 252/89 |
| 3,801,709 | 4/1974 | Augsburger et al. | 424/69 |
| 3,928,429 | 12/1975 | El-Chahawi et al. | 260/515 R |
| 3,974,201 | 8/1976 | Boelens | 260/471 R |
| 4,052,423 | 10/1977 | Larock | 260/410.9 R |
| 4,190,561 | 2/1980 | Auger et al. | 252/522 R |
| 4,217,250 | 8/1980 | Holzner | 252/522 R |
| 4,265,777 | 5/1981 | Boyer et al. | 252/113 |

OTHER PUBLICATIONS

Miles Laboratories Technical Information Bulletin, (1980).

*Primary Examiner*—John E. Kittle
*Assistant Examiner*—Robert A. Wax
*Attorney, Agent, or Firm*—Robert B. Aylor; Richard C. Witte; Thomas H. O'Flaherty

[57] ABSTRACT

Alkaline aqueous liquid detergent compositions comprising zeolite A, a nonionic surfactant, a polycarboxylate detergency builder and an unsaturated soap which are substantially free of synthetic anionic surfactants that can contain normally unstable ester perfumes without a stability problem.

12 Claims, No Drawings

ALKALINE AQUEOUS LIQUID DETERGENT COMPOSITIONS CONTAINING NORMALLY UNSTABLE ESTER PERFUMES

CROSS REFERENCE TO RELATED APPLICATION

This application is a continuation-in-part of my copending application Ser. No. 301,673, filed Sept. 14, 1981, now abandoned, for Alkaline Aqueous Liquid Detergent Compositions Containing Normally Unstable Ester Perfumes.

TECHNICAL FIELD

This invention relates to alkaline aqueous liquid detergent compositions utilizing ester-containing perfumes. The large class of perfumes known as ester perfumes which contain the structure

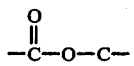

are generally unstable in alkaline aqueous liquid detergent compositions. The alkalinity promotes decomposition by hydrolysis. As a consequence, the composition so affected can have an undesirable odor. Therefore, such perfumes generally are not used in alkaline aqueous liquid detergent compositions.

Accordingly, an object of this invention is to permit the addition of ester perfumes to alkaline aqueous liquid detergent compositions without a stability problem.

A further object of the invention is to provide alkaline aqueous liquid detergent compositions which contain ester perfumes without a stability problem.

BACKGROUND ART

U.S. Pat. No. 4,265,777 discloses liquid detergent compositions consisting of a synthetic detergent surfactant, unsaturated fatty acid soap and an aluminosilicate detergency builder.

U.S. Pat. No. 4,217,250 discloses that polycarboxylates may be added to perfumes to sequester metal ions which act as a catalyst for oxidation.

U.S. Pat. No. 3,668,134 recognizes the problem that ester perfumes are generally unstable in alkaline aqueous liquid detergent compositions. It discloses that esters of tetrahydrofuran and tetrahydropyran are stable in such compositions.

SUMMARY OF THE INVENTION

The present invention relates to alkaline aqueous liquid detergent compositions comprising:

(a) from about 7% to about 30% of zeolite A detergency builder;

(b) from about 5% to about 40% of a water-soluble or dispersible soap of unsaturated fatty acids containing from about 16 to 22 carbon atoms; and (c) from about 1% to about 30% of a nonionic surfactant;

(d) from about 5% to about 15% of a water-soluble polycarboxylate detergency builder capable of sequestering calcium and magnesium ions in water solution;

(e) from about 0.01% to about 4% of a perfume material containing from about 4% to about 90% ester compounds, by weight of total perfume material, that are not normally stable in alkaline aqueous liquid detergent compositions; and (f) from about 20% to about 82% water; wherein said compositions are substantially free of synthetic anionic surfactants.

DISCLOSURE OF THE INVENTION

The present invention relates to the fact that ester perfumes that are normally unstable in alkaline aqueous liquid detergent compositions are stable in such compositions provided such compositions comprise zeolite A, an unsaturated fatty acid soap, a nonionic surfactant and a polycarboxylate detergency builder and are substantially free of synthetic anionic surfactants. The pH of such compositions ranges from about 9.5 to about 11.5 and preferably from about 10 to about 11. Such stability is totally unexpected because most ester perfumes in such highly alkaline aqueous liquid detergent compositions decompose by hydrolysis during storage.

The essential components of the detergent compositions of this invention are (1) zeolite A, (2) an unsaturated fatty acid soap, (3) a nonionic surfactant, (4) a polycarboxylate builder, and (5) a normally unstable ester perfume. Also, the detergent compositions within the invention are substantially free of synthetic anionic surfactants. The addition of a synthetic anionic surfactant to the detergent compositions within the invention renders the ester perfume unstable.

As used herein all percentages, weights and ratios are by weight unless otherwise specified.

THE ALUMINOSILICATE DETERGENCY BUILDER

Detergency builders are generally characterized by an ability to sequester or precipitate water hardness ions, calcium and magnesium in particular. Detergency builders may also be used to maintain or assist in maintaining an alkaline pH in a washing solution.

The aluminosilicate detergency builder for use herein is commonly known as hydrated zeolite A. It should contain at least about 10% water of hydration, preferably at least about 18% water of hydration and should have a particle size of from about 0.01 micron to about 25 microns, preferably from about 0.1 micron to about 10 microns, more preferably from about 0.5 micron to about 5 microns. This aluminosilicate material is more fully described in U.S. Pat. No. 4,096,081, Phenicie et al, issued June 20, 1978 and U.S. Pat. No. 4,180,485, Llenado, issued Dec. 25, 1979. Both patents are incorporated herein by reference.

Zeolite A should preferably be free of any substantial amount of particles having a diameter above about 10 microns. Also, it should have a calcium ion exchange capacity of at least about 100 milligrams equivalents of calcium carbonate per gram, preferably at least 200 milligram equivalents of calcium carbonate per gram and most preferably at least 250 milligram equivalents of calcium carbonate per gram on an anhydrous basis. The initial ion exchange rate should be at least 2 grains/gallon/minute/gram/gallon as measured at room temperature in the presence of 7 grains of mixed 2:1 $Ca^{++}$:$Mg^{++}$ and a level of detergency builder sufficient to control that level of hardness. This initial rate can be approximated by drawing a line from the initial point to the level of hardness after ½ minute as determined by a calcium ion specific electrode.

The amount of zeolite A in the compositions is from about 7% to about 30%, preferably from about 10% to about 20% and most preferably from about 10% to about 15%.

Additional crystalline aluminosilicate detergency builder materials such as those commonly known as hydrated zeolites X and P(B) and amorphous hydrated aluminosilicate material of the empirical formula $$M_Z(ZAlO_2 \cdot ySiO_2)$$

wherein M is sodium, potassium or ammonium, Z is from about 0.5 to about 2; and y is 1, can be present. These aluminosilicate materials are more fully described in the two patents cited above.

The amount of such additional aluminosilicates in the compositions can be present at levels of from 0% to about 3%, but preferably they are not present at all.

THE UNSATURATED SOAP

The unsaturated fatty acid soap of this invention contains from about 16 to about 22 carbon atoms, preferably in a straight chain configuration. Preferably the number of carbon atoms in the unsaturated fatty acid soap is from about 16 to about 18.

This unsaturated soap, in common with other anionic materials in the detergent compositions of this invention, has a cation which renders the soap water-soluble and/or dispersible. Suitable cations include sodium, potassium, ammonium, monethanolammonium, diethanolammonium, triethanolammonium, tetramethylammonium, etc. cations. Sodium ions are preferred although in more concentrated liquid formulations potassium, monoethanolammonium, diethanolammonium, and triethanolammonium cations are useful.

A level of at least about 5% of the unsaturated fatty acid soap is desirable to provide a noticeable improvement in performance. Preferred levels of unsaturated fatty acid soap are from about 5% to about 40%, preferably from about 5% to about 30% and most preferably from about 5% to about 15%. The unsaturated fatty acid soap is preferably present at a level that will provide a level of from about 150 ppm to about 600 ppm, preferably from about 150 ppm to about 300 ppm in the wash solution at recommended U.S. usage levels and from about 150 ppm to about 2400 ppm, preferably from about 600 ppm to about 1500 ppm for European usage levels. The aluminosilicate assists in keeping the unsaturated soap from forming an insoluble curd.

Mono-, di-, and tri-unsaturated fatty acids are all essentially equivalent so it is preferred to use mostly mono-unsaturated soaps to minimize the risk of rancidity. Suitable sources of unsaturated fatty acids are well known. For example, see Bailey's Industrial Oil and Fat Products, Third Edition, Swern, published by Interscience Publisher (1964), incorporated herein by reference.

Preferably, the level of saturated soaps is kept as low as possible, preferably less than about 50% of the unsaturated soap. However, low levels of saturated soaps can be added and will provide some performance for clay and dirt removal if they contain at least 16 carbon atoms. Tallow and palm oil soaps can be used if cost considerations are important, but will not give as good results as can be obtained with all unsaturated soap. Coconut soap does not provide a benefit and should not be added in significant amounts.

THE SYNTHETIC SURFACTANT

In addition to the unsaturated fatty acid soap there is a nonionic surfactant present, especially one which is an efficient soap curd dispersant. The preferred nonionic surfactant can be either a water-soluble nonionic or a semi-polar nonionic surfactant or mixtures thereof. Especially preferred nonionic surfactants are those which are relatively hardness insensitive.

Suitable nonionic surfactants can be prepared by a variety of methods well known in the art. In general terms, such nonionic surfactants are typically prepared by condensing ethylene oxide with a compound containing an active hydrogen under conditions of acidic or basic catalysis. Nonionic surfactants for use herein comprise those typical nonionic surface active agents well known in the detergency arts. Useful nonionic surfactants include those described in U.S. Pat. No. 4,075,118, Gault et al, issued Feb. 21, 1978; U.S. Pat. No. 4,079,078, Collins, issued Mar. 14, 1978; and U.S. Pat. No. 3,963,649, Spadini et al, issued June 15, 1976, all of the above patents being incorporated herein by reference.

The most conventional nonionic surfactants useful herein are those having the formula:

$$R(O)(C_2H_4O)_X—R^1$$

wherein R is an alkyl, hydroxy alkyl, alkylene, hydroxy alkylene, acyl, or hydroxy acyl group containing from about 8 to about 22 carbon atoms or an alkylphenyl group wherein the alkyl group contains from about 6 to about 15 carbon atoms or mixtures thereof; X is a number from 0 to about 30; and $R^1$ is selected from the group consisting of H, alkyl groups containing from 1 to about 4 carbon atoms, acyl groups containing from 2 to about 4 carbon atoms and mixtures thereof. The HLB of these nonionic surfactants is preferably from about 5 to about 20, most preferably from about 8 to about 14.

Suitable semi-polar nonionic surfactants include tertiary amine oxides containing a straight or branched chain saturated or unsaturated aliphatic hydrocarbon, hydroxy hydrocarbon or halohydrocarbon radical in which the alkyl portion contains from 8 to 24 carbon atoms and two short chain methyl, ethyl, hydroxymethyl or hydroxyethyl radicals. Other suitable semi-polar nonionic detergent surfactants include the corresponding tertiary phosphine oxides and the sulfoxides.

The formula for representative surfactants is $$R(OC_2H_4)_X\overset{\overset{\displaystyle O}{\uparrow}}{N}R_2^2$$

where R and X are as stated hereinbefore and each $R^2$ is selected from the group consisting of $C_{1-4}$ alkyl and hydroxy alkyl groups and polyethoxylate groups containing from 0 to about 10 ether linkages.

The level of nonionic surfactant present is from about 1% to about 30%, preferably from about 3% to about 20% and most preferably from about 5% to about 15%.

Other synthetic detergent surfactants such as anionic detergent surfactants, cationic detergent surfactants, zwitterionic detergent surfactants and amphoteric detergent surfactants can be present. Suitable synthetic detergent surfactant compositions are disclosed in U.S. Pat. No. 4,265,777, Boyer et al, issued May 5, 1981, incorporated herein by reference. Such synthetic detergent surfactant levels can not exceed 10% of the level of nonionic surfactant.

WATER-SOLUBLE POLYCARBOXYLATE DETERGENCY BUILDERS

In addition to having the ability to sequester calcium or magnesium ions in water solution, the polycarboxylate detergency builders of the present invention are essential to stabilizing the ester perfume.

The water-soluble polycarboxylates of the present invention fall into several classes of organic compounds having carboxylate structures including amino polycarboxylates, cycloalkane polycarboxylates, ether polycarboxylates, alkyl polycarboxylates, epoxy polycarboxylates, tetrahydrofuran polycarboxylates, and benzene polycarboxylates.

Examples of suitable materials for use herein are sodium and potassium ethylenediaminetetraacetates, the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103; and water-soluble salts of polycarboxylate polymers and copolymers as described in U.S. Pat. No. 3,308,067, Diehl, issued Mar. 7, 1967, incorporated herein by reference. Water-soluble salts of nitrilotriacetic acid can be used herein.

A useful polycarboxylate which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described polycarboxylates include polymers of itaconic acid, aconitic acid, maleic acid, mesaconic acid, fumaric acid, methylene malonic acid, and citraconic acid and copolymers with themselves.

In addition, other polycarboxylates which can be used satisfactorily include water-soluble salts, especially the sodium and potassium salts of mellitic acid, citric acid, pyromellitic acid, benzene pentacarboxylic acid, oxydiacetic acid, carboxymethyloxysuccinic acid, carboxymethloxymalonic acid, cis-cyclohexanehexacarboxylic acid, cis-cyclopentanetetracarboxylic acid, and oxydisuccinic acid.

It is to be understood that while the alkali metal, and particularly the sodium and potassium salts of the foregoing inorganic and organic detergency builder salts are preferred for use herein from economic and solubility standpoints, the alkanolammonium e.g., triethanolammonium, diethanolammonium, and the like, water-soluble salts of any of the foregoing builder anions are also useful herein.

The preferred polycarboxylates for use in the present invention are nitrilotriacetates and citrates and mixtures thereof, especially sodium and potassium nitrilotriacetate, sodium and potassium citrate, and mixtures thereof. The nitrilotriacetates are the most preferred.

The amount of polycarboxylate detergency builder contained in the detergent compositions is from about 5% to about 15% and most preferably from about 6% to about 12%.

THE PERFUMES

The perfumes that can be used in the practice of the invention are ester perfumes. Examples of esters that can be used are acetates, anthranilates, benzoates, butyrates, cinnamates, formates, isobutyrates, phenylacetates and propionates. Some ester perfumes that can now be contained in alkaline aqueous liquid detergent compositions, but could not be before are: anisyl acetate, benzyl benzoate, cedryl formate, cinnamyl isobutyrate, citronellyl acetate, citronellyl formate, dihydrocarvyl acetate, diheptyl acetate, ethyl phenyl acetate, furfuryl phenyl acetate, geranyl benzoate, geranyl butyrate, hexyl caproate, isobutyl phenol acetate, isononyl acetate, isononyl propionate, linalyl acetate, linalyl formate, phenoxy ethyl isobutyrate, benzyl acetate, tricyclodecenyl acetate, tricyclodecanyl propionate, geranyl acetate, phenyl ethyl acetate, pseudo linalyl acetate and methyl benzoate and mixtures thereof.

The ester perfume may contain other perfume ingredients that are stable in alkaline aqueous liquid detergent compositions. Examples are acetals, alcohols, aldehydes, cyclic nitrogen compounds, ethers, hydrocarbons, ketones, lactones, musks and phenols. Thus it can easily be seen that numerous perfumes may be used within the scope of the invention. An example of such a perfume is:

| | % by Weight |
|---|---|
| Citronellol | 19.1 |
| Phenoxy Ethyl Isobutyrate | 19.1 |
| Benzyl Acetate | 6.7 |
| Linalool | 21 |
| Tricyclodecenyl Acetate | 11.5 |
| Tricyclodecenyl Propionate | 5.8 |
| Geranyl Acetate | 3.8 |
| Pheny Ethyl Acetate | 4.8 |
| Pseudo Linalyl Acetate | 7.6 |
| Methyl Benzoate | .6 |
| Total | 100.0 |

The amount of perfume material contained in the detergent compositions is from about 0.01% to about 4%, preferably from about 0.1% to about 1% and most preferably from about 0.2% to about 0.8% with normally unstable ester perfumes constituting from about 4% to about 90%, preferably from about 10% to about 60% and most preferably from about 25% to about 50% of the total weight of the perfume material.

MISCELLANEOUS INGREDIENTS

In addition to the above named ingredients, the compositions of this invention can contain all of the usual components of detergent compositions including the ingredients set forth, except for the perfume, in U.S. Pat. No. 3,936,537, Baskerville et al, incoporated herein by reference. Such components include color speckles, bleaching agents, bleach activators, suds boosters, suds suppressors, antitarnish and/or anticorrosion agent, soil-suspending agents, soil-release agents, dyes, fillers, optical brighteners, germicides, pH adjusting agents, alkalinity sources, hydrotropes, antioxidants, enzymes, enzyme stabilizing agents, etc.

Preferred optional ingredients include suds modifiers particularly those of suds suppressing types, exemplified by silicones, and silica-silicone mixtures.

U.S. Pat. No. 3,933,672, Bartollota et al, issued Jan. 20, 1976, and 4,136,045, Gault et al, issued Jan. 23, 1979, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

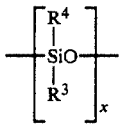

wherein x is from about 20 to about 2,000 and $R^3$ and $R^4$ are each alkyl or aryl groups, especially methyl, ethyl, propyl, butyl and phenyl. The polydimethylsiloxanes ($R^3$ and $R^4$ are methyl) having a molecular weight within the range of from about 200 to about 2,000,000, and higher, are all useful as suds controlling agents. Additional suitable silicone materials wherein the side chain groups $R^3$ and $R^4$ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above can be used at levels of up to approximately 2%, preferably from about 0.1 to about 1½% by weight of the surfactant.

Low levels of additional water-soluble detergency builders, e.g., from about 1% to about 35%, preferably from about 5% to about 20% can also be used.

Nonlimiting examples of suitable water-soluble inorganic alkaline detergent builder salts include the alkali metal carbonates, borates, bicarbonates, and silicates. Specific examples of such salts include the sodium and potassium tetraborates, bicarbonates and carbonates.

Preferred soil suspending and antiredeposition agents include methyl cellulose derivatives and the copolymers of maleic anhydride and either methyl vinyl ether or ethylene, e.g., Gantrez AN119 or Gantrez 595 (trade names of GAF).

The odor of the detergent compositions was determined by a sensory evaluation. Sensory evaluations are generally used in making such determinations. Analytical determinations are generally not possible.

The results were based upon an odor grading scale of 1–10, with 10 being the most desirable value and lower values indicating less desirable odors, due to poorer masking of product base odor or development of undesirable perfume notes.

EXAMPLE I

A perfume, containing esters that are generally unstable in alkaline aqueous liquid media, was prepared by admixing the following components:

| | % by Weight |
|---|---|
| Citronellol | 19.1 |
| Phenoxy Ethyl Isobutyrate | 19.1 |
| Benzyl Acetate | 6.7 |
| Linalool | 21 |
| Tricyclodecenyl Acetate | 11.5 |
| Tricyclodecenyl Propionate | 5.8 |
| Geranyl Acetate | 3.8 |
| Pheny Ethyl Acetate | 4.8 |
| Pseudo Linalyl Acetate | 7.6 |
| Methyl Benzoate | .6 |
| Total | 100.0 |

EXAMPLE II

The following detergent compositions were prepared.

| | % by weight | | | |
|---|---|---|---|---|
| | A[1] | B | C[1] | D |
| Sodium Zeolite A | 13.3 | 13.3 | 0 | 13.3 |
| Sodium Zeolite X | 0 | 0 | 13.3 | 0 |
| Sodium Oleate | 10.9 | 10.9 | 10.9 | 0 |
| Sodium Pyrophosphate | 0 | 0 | 0 | 0 |
| Sodium Nitrilotriacetate | 7.9 | 0 | 7.9 | 7.9 |
| Sodium Citrate | 0 | 0 | 0 | 0 |
| $C_{12-13}$ Alkyl Polyethoxylate$_{6.5}$ ($C_{12-13}AE_{6.5}$) | 6.6 | 6.6 | 6.6 | 6.6 |
| Sodium Alkyl Ethoxylate Sulfate ($C_{14-15}AE_{2.25}S$) | 0 | 0 | 0 | 0 |
| Sodium Carbonate | 3.7 | 3.7 | 3.7 | 3.7 |
| Dimethyldodecylamine Oxide | 3.4 | 3.4 | 3.4 | 3.4 |
| Ethanol | 2.2 | 2.2 | 2.2 | 2.2 |
| Perfume of Example I | .4 | .4 | .4 | .4 |
| $H_2O$ | BALANCE | | | |

[1]Detergent compositions A and C were prepared and graded twice as shown in L and M respectively.

| | % by weight | | | |
|---|---|---|---|---|
| | E | F | G | H |
| Sodium Zeolite A | 0 | 13.3 | 13.3 | 13.3 |
| Sodium Zeolite X | 0 | 0 | 0 | 0 |
| Sodium Oleate | 10.9 | 10.9 | 10.9 | 10.9 |
| Sodium Pyrophosphate | 0 | 7.9 | 0 | 0 |
| Sodium Nitrilotriacetate | 7.9 | 0 | 0 | 0 |
| Sodium Citrate | 0 | 0 | 7.9 | 7.9 |
| $C_{14-15}AE_{2.25}S$ | 0 | 0 | 0 | 0 |
| $C_{12-13}AE_{6.5}$ | 6.6 | 6.6 | 6.6 | 6.6 |
| Sodium Carbonate | 3.7 | 3.7 | 3.7 | 2.5 |
| Dimethyldodecylamine Oxide | 3.4 | 3.4 | 3.4 | 3.4 |
| Ethanol | 2.2 | 2.2 | 2.2 | 2.2 |
| Perfume of Example I | .4 | .4 | .4 | .4 |
| $H_2O$ | BALANCE | | | |
| | I | J | K | L |
| Sodium Zeolite A | 13.3 | 13.3 | 13.3 | 13.3 |
| Sodium Zeolite X | 0 | 0 | 0 | 0 |
| Sodium Oleate | 10.9 | 10.9 | 10.9 | 10.9 |
| Sodium Pyrophosphate | 0 | 0 | 0 | 0 |

-continued

| | % by weight | | | |
|---|---|---|---|---|
| Sodium Nitrilotriacetate | 7.9 | 7.9 | 7.9 | 7.9 |
| Sodium Citrate | 0 | 0 | 0 | 0 |
| $C_{12-13}AE_{6.5}$ | 0 | 4.6 | 5.9 | 6.6 |
| $C_{14-15}AE_{2.25}S$ | 10.0 | 3 | 1 | 0 |
| Sodium Carbonate | 3.7 | 3.7 | 3.7 | 3.7 |
| Dimethyldodecylamine Oxide | 0 | 2.4 | 3.1 | 3.4 |
| Ethanol | 2.2 | 2.2 | 2.2 | 2.2 |
| Perfume of Example I | .4 | .4 | .4 | .4 |
| $H_2O$ | BALANCE | | | |

| | M | N | O |
|---|---|---|---|
| Sodium Zeolite A | 0 | 6.65 | 6.65 |
| Sodium Zeolite X | 13.3 | 6.65 | 0 |
| Sodium Oleate | 10.9 | 10.9 | 10.9 |
| Sodium Pyrophosphate | 0 | 0 | 0 |
| Sodium Nitrilotriacetate | 7.9 | 7.9 | 7.9 |
| Sodium Citrate | 0 | 0 | 0 |
| $C_{12-12}AE_{6.5}$ | 6.6 | 6.6 | 6.6 |
| $C_{14-15}AE_{2.25}S$ | 0 | 0 | 0 |
| Sodium Carbonate | 3.7 | 3.7 | 3.7 |
| Dimethyldodecylamine Oxide | 3.4 | 3.4 | 3.4 |
| Ethanol | 2.2 | 2.2 | 2.2 |
| Perfume of Example I | .4 | .4 | .4 |
| $H_2O$ | BALANCE | | |

The samples were thoroughly mixed to obtain an aqueous liquid detergent composition containing a suspended aluminosilicate, then 0.4% by weight of the perfume of Example I was added.

After 72 hours of storage at room temperature, the product odors of the composition above were compared and rated. The results were as follows:

SAMPLE:

A. 8.5 intended product odor
B. 6 fatty, soapy note
C. 5 dirty, acrid, fatty, soapy note
D. 4 strong sour chemical note
E. 7 slightly sour, amine note
F. 6 sour winey note
G. 7.5 slightly acrid, fatty note
H. 8.5 intended product odor
I. 6.0 sour, winey, slightly fatty note
J. 5.0 dirty, acrid, fatty, soap note
K. 7.5 slightly fatty, soapy note
L. 8.5 intended product odor
M. 5.0 dirty, acrid, fatty, soapy note
N. 5.0 dirty, acrid, fatty, soapy note
O. 7.0 slightly fatty, soapy note The deviations from the intended product odor are consistent with decomposition of ester perfume ingredients. Compositions A, G, H, K and L, which contain components within the practice of the invention, have relatively more acceptable product odors. It should be noted that composition J, which contains 3% of a synthetic anionic surfactant, had an unacceptable product odor whereas a similar composition, composition K, which contains only 1% of the same synthetic anionic surfactant, had an acceptable product odor.

When in the above detergent compositions the following normally unstable ester perfume compounds are substituted either totally or partially (e.g. 1:1 ratio) for the ester compounds of the above detergent compositions, then substantially equivalent results are obtained in that the detergent compositions of the invention stabilize the normally unstable ester perfume compounds: anisyl acetate, benzyl benzoate, cedryl formate, cinnamyl isobutyrate, citronellyl acetate, citronellyl formate, dihydrocarvyl acetate, diheptyl acetate, ethyl phenyl acetate, furfuryl phenyl acetate, geranyl benzoate, geranyl butyrate, hexyl caproate, isobutyl phenol acetate, isononyl acetate, isononyl propionate, linalyl acetate, linalyl formate, phenoxy ethyl isobutyrate, benzyl acetate, tricyclodecenyl acetate, tricyclodecenyl propionate, geranyl acetate, phenyl ethyl acetate, pseudo linalyl acetate and methyl benzoate.

EXAMPLE III

The following detergent compositions can contain ester perfumes without a stability problem:

| | % by weight | |
|---|---|---|
| Sodium Zeolite A | 10 | 15 |
| Sodium Oleate | 15 | 5 |
| Sodium Nitrilotriacetate | 8 | 12 |
| $C_{12-13}AE_{6.5}$ | 6 | 5 |
| Sodium Carbonate | 2 | 3 |
| Dimethyldodecylamine Oxide | 6 | 7 |
| Ethanol | 2 | 3 |
| $H_2O$ | BALANCE | |

What is claimed is:

1. An alkaline aqueous liquid detergent composition comprising:

(a) from about 7% to about 30% of zeolite A detergency builder;

(b) from about 5% to about 40% of a water-soluble or water-dispersible soap of unsaturated fatty acids containing from about 16 to 22 carbon atoms;

(c) from about 1% to about 30 of a nonionic surfactant;

(d) from about 5% to about 15% of a water-soluble polycarboxylate detergency builder capable of sequestering calcium and magnesium ions in water solution;

(e) from about 0.01% to about 4% of a perfume material comprising from about 4% to about 90% of the total weight of the perfume of normally unstable ester compounds; and (f) from about 20% to about 82% water; wherein said composition is substantially free of synthetic anionic surfactants.

2. The composition of claim 1 wherein the ester perfume compound is selected from the group consisting of: acetates, anthranilates, benzoates, butyrates, cinnamates, formates, isobutyrates, phenylacetates and propionates and mixtures thereof.

3. The composition of claim 1 wherein the perfume material is from about 0.1% to about 1% by weight of the composition with said normally unstable ester compounds constituting from about 10% to about 60% of the total weight of the perfume material.

4. The composition of claim 1 wherein said zeolite A contains at least about 10% water of hydration by weight and has a particle size of from about 0.1 micron to about 10 microns and is present in an amount of from about 7% to about 20% by weight of the composition.

5. The composition of claim 4 wherein zeolite A contains at least 18% water of hydration and has a particle size from about 0.5 to about 1.5 microns.

6. The composition of claim 1 wherein the water-soluble polycarboxylate level is from about 6% to about 12%.

7. The composition of claim 6 wherein the polycarboxylate detergency builder is a water-soluble, sodium, potassium, lithium, ammonium or substituted ammonium salt of nitrilotriacetic acid.

8. The compositions of claim 1 wherein the nonionic surfactant is selected from the group consisting of:

$$R(O)(C_2H_4O)_X—R^1 \quad (a)$$

wherein R is an alkyl, hydroxy, alkyl, alkylene, hydroxy alkylene, acyl, or hydroxy acyl group containing from about 8 to about 22 carbon atoms or an alkylbenzene group wherein the alkyl group contains from about 6 to about 15 carbon atoms or an alkylbenezene group wherein the alkyl group contains from about 6 to about 15 carbon atoms and mixtures thereof; X is a number from 0 to about 30; and $R^1$ is selected from the group consisting of H, alkyl groups containing from 1 to about 4 carbon atoms, acyl groups containing from 2 to about 4 carbon atoms and mixtures thereof;

(b) semi-polar nonionic detergent surfactants having the formula:

$$R(OC_2H_4)_X\overset{\overset{\displaystyle O}{\uparrow}}{N}R_2^2$$

wherein R and X are as stated hereinbefore and each $R^2$ is selected from the group consisting of $C_{1-4}$ alkyl and hydroxy alkyl groups and polyethoxylate groups containing from 0 to about 10 ether linkages; and (c) mixtures thereof.

9. The composition of claim 8 wherein the nonionic surfactant comprises from about 3% to about 20% of the composition.

10. A composition according to claim 4 or claim 8 wherein the fatty acid of the soap contains from about 16 to about 18 carbon atoms, and the cation of the soap is selected from the group consisting of sodium, potassium, ammonium, monoethanolammonium, diethanolammonium, triethanolammonium, tetramethylammonium, and mixtures thereof.

11. A composition according to claim 4 or claim 8 wherein the unsaturated fatty acid soap is from about 5% to about 30% by weight of the composition.

12. A composition according to claim 1 wherein: the perfume material is from about 0.1% to about 1% by weight of the composition with said normally unstable ester compounds constituting from about 10% to about 60% of the total weight of the perfume material; said zeolite A contains at least 18% water of hydration and has a particle size from about 0.5 to about 1.5 microns and is present at levels from about 10% to about 15%; the water-soluble polycarboxylate detergency builder is a water-soluble, sodium, potassium, lithium, ammonium or substituted ammonium salt of nitrilotriacetic acid present at levels from about 6% to about 12%; the nonionic surfactant level is from about 5% to about 15%; and the fatty acid soap level is from about 5% to about 15%.

* * * * *